US011363848B1

(12) United States Patent
Goodman

(10) Patent No.: US 11,363,848 B1
(45) Date of Patent: Jun. 21, 2022

(54) ELASTIC BAND CAP SYSTEM

(71) Applicant: Steven Goodman, Clearwater Beach, FL (US)

(72) Inventor: Steven Goodman, Clearwater Beach, FL (US)

( * ) Notice: Subject to any disclaimer, the term of this patent is extended or adjusted under 35 U.S.C. 154(b) by 0 days.

(21) Appl. No.: 15/909,387

(22) Filed: Mar. 1, 2018

Related U.S. Application Data

(60) Provisional application No. 62/500,115, filed on May 2, 2017.

(51) Int. Cl.
*A42B 1/008* (2021.01)
*A42B 1/22* (2006.01)
*A42B 1/0181* (2021.01)

(52) U.S. Cl.
CPC ..... *A42B 1/008* (2013.01); *A42B 1/0181* (2021.01); *A42B 1/22* (2013.01)

(58) Field of Classification Search
CPC ..... A42B 1/008; A42B 1/22; A42B 1/061; A42B 1/069; A42B 1/002; A42B 3/10; A42B 3/283; A42B 1/225; A42C 5/04; A42C 3/00
USPC ..... 2/175.1, 182.1, 182.3, 182.8, 183
See application file for complete search history.

(56) References Cited

U.S. PATENT DOCUMENTS 5,799,334 A * 9/1998 Griffith ..... A42B 1/225 2/171
6,016,572 A * 1/2000 Park ..... A42B 1/22 2/195.2
6,052,831 A * 4/2000 Park ..... A42B 1/22 2/175.1
6,163,888 A * 12/2000 Park ..... A42B 1/22 2/183
6,336,224 B1 * 1/2002 Wang ..... A42B 1/22 2/195.3
8,108,944 B1 * 2/2012 Gilson, Sr. ..... A42B 1/247 2/12
9,877,533 B2 * 1/2018 Arnott ..... A42B 1/225
2004/0083532 A1 * 5/2004 Laloy ..... A42B 1/22 2/170
2004/0128738 A1 * 7/2004 Park ..... A42B 1/22 2/195.1
2004/0210986 A1 * 10/2004 Yan ..... A42B 1/248 2/171
2005/0223474 A1 * 10/2005 Cho ..... A42B 1/22 2/195.3
2006/0041992 A1 * 3/2006 Liao ..... A42B 1/22 2/195.3
2008/0201825 A1 * 8/2008 Chun ..... A42B 1/225 2/209.13
2009/0255035 A1 * 10/2009 Little ..... A42B 1/22 2/183

(Continued)

*Primary Examiner* — Khoa D Huynh
*Assistant Examiner* — Uyen T Nguyen

(57) ABSTRACT

A crown portion has elastic sections and non-stretchable sections, open sections devoid of both elastic sections and non-stretchable sections for ventilation purposes, and a top and a bottom. The open sections include plural open sections closer to the top than to the bottom and plural open sections closer to the bottom than to the top. A circumferential portion has elastic sections and non-stretchable sections, a lower edge, a front, a back, a left side, and a right side. The circumferential portion adjacent to the lower edge is coupled to the bottom of the crown portion.

1 Claim, 4 Drawing Sheets

(56) References Cited

U.S. PATENT DOCUMENTS

| | | | | |
|---|---|---|---|---|
| 2010/0000004 | A1* | 1/2010 | Levac | A41D 1/04 2/108 |
| 2011/0047673 | A1* | 3/2011 | Mao | A42B 1/22 2/181 |
| 2014/0082826 | A1* | 3/2014 | Kuthari | A42B 1/02 2/171.7 |
| 2014/0130235 | A1* | 5/2014 | Johnson | A42B 1/241 2/209.3 |
| 2017/0020222 | A1* | 1/2017 | Arnott | A42B 1/225 |
| 2017/0119077 | A1* | 5/2017 | Purviance | A42B 1/22 |

* cited by examiner 400
406
404
410
412
418
416
412
410

404
420
422

410
406
412
410
412
404

424

ELASTIC BAND CAP SYSTEM

RELATED APPLICATION

The present application is based upon Provisional Application No. 62/500,115, filed May 2, 2017, the subject matter of which is incorporated herein by reference, and the priority of which is hereby claimed.

BACKGROUND OF THE INVENTION

Field of the Invention

The present invention relates to an elastic cap system and more particularly pertains to providing a proper cap fit with attendant comfort and style.

Description of the Prior Art

The use of cap systems of known design and configurations is known in the prior art. More specifically, cap systems of known design and configurations previously devised and utilized for the purpose of fitting caps are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe an elastic cap system that allows providing a proper cap fit with attendant comfort and style.

In this respect, the elastic cap system according to the present invention substantially departs from the conventional concepts and designs of the prior art, and in doing so provides an apparatus primarily developed for the purpose of providing a proper cap fit with attendant comfort and style.

Therefore, it can be appreciated that there exists a continuing need for a new and improved elastic cap system which can be used for providing a proper cap fit with attendant comfort and style. In this regard, the present invention substantially fulfills this need.

SUMMARY OF THE INVENTION

In view of the disadvantages inherent in the known types of cap systems of known design and configurations now present in the prior art, the present invention provides an improved elastic cap system. As such, the general purpose of the present invention, which will be described subsequently in greater detail, is to provide a new and improved elastic cap system and method which has all the advantages of the prior art and none of the disadvantages.

To attain this, from a broad perspective, the present invention essentially comprises a crown portion and a circumferential portion. The crown portion has elastic sections and non-stretchable sections, open sections devoid of both elastic sections and non-stretchable sections for ventilation purposes, and a top and a bottom. The open sections include plural open sections closer to the top than to the bottom and plural open sections closer to the bottom than to the top. The circumferential portion has elastic sections and non-stretchable sections, a lower edge, a front, a back, a left side, and a right side. The circumferential portion adjacent to the lower edge is coupled to the bottom of the crown portion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved elastic cap system which has all of the advantages of the prior art cap systems of known design and configurations and none of the disadvantages.

It is another object of the present invention to provide a new and improved elastic cap system which may be easily and efficiently manufactured and marketed.

It is a further object of the present invention to provide a new and improved elastic cap system which is of durable and reliable constructions.

An even further object of the present invention is to provide a new and improved elastic cap system which is susceptible of a low cost of manufacture with regard to both materials and labor, and which accordingly is then susceptible of low prices of sale to the consuming public, thereby making such elastic cap system economically available to the buying public.

Lastly, it is an object of the present invention to provide an elastic cap system for providing a proper cap fit with attendant comfort and style.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
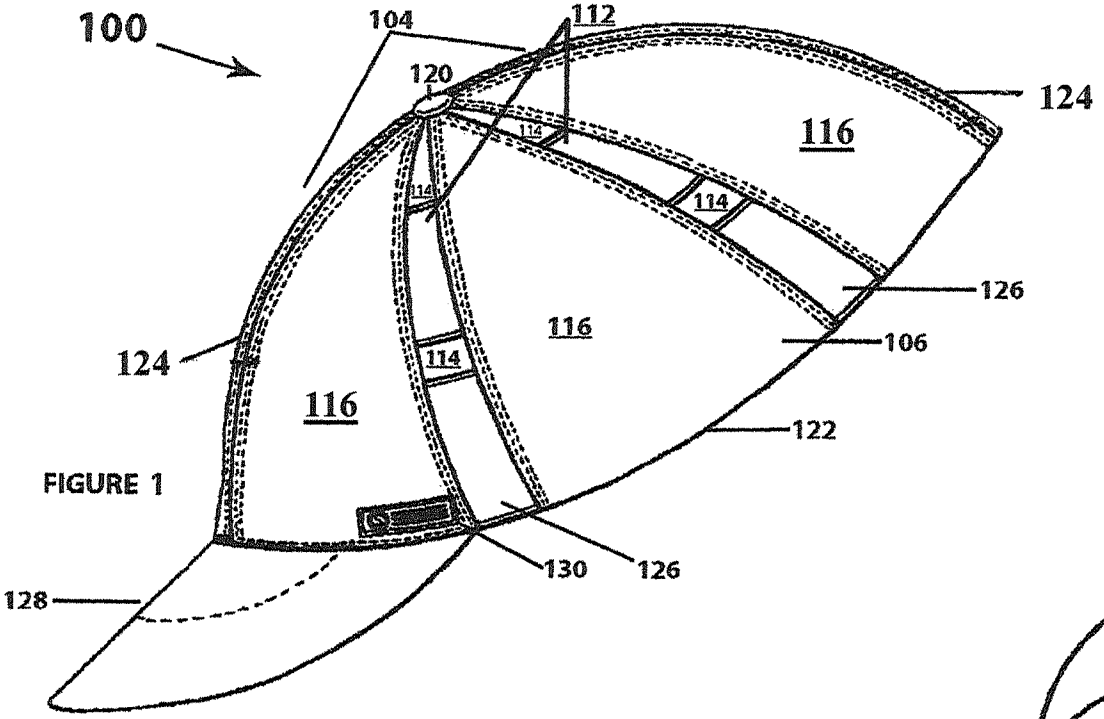
FIG. 1 is a side elevational view of an elastic cap system constructed in accordance with the principles of the present invention.
Figure 1B:
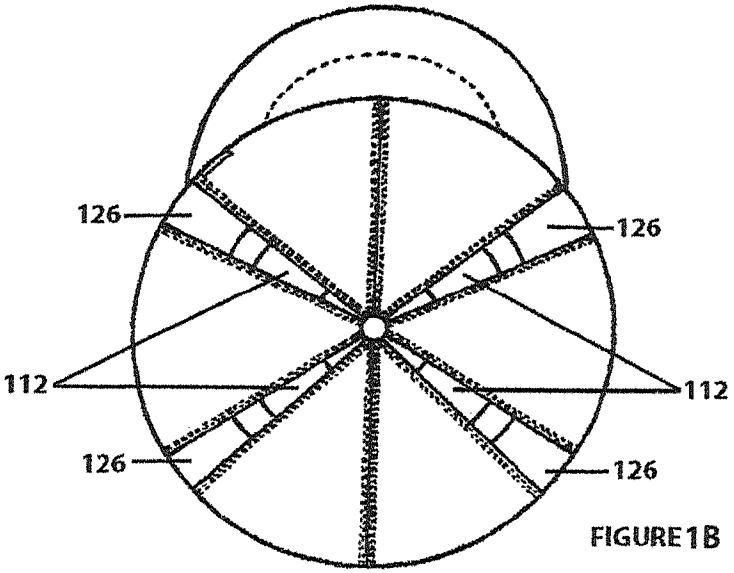
FIG. 1B is a plan view of the system shown in the prior Figures.
Figure 1A:
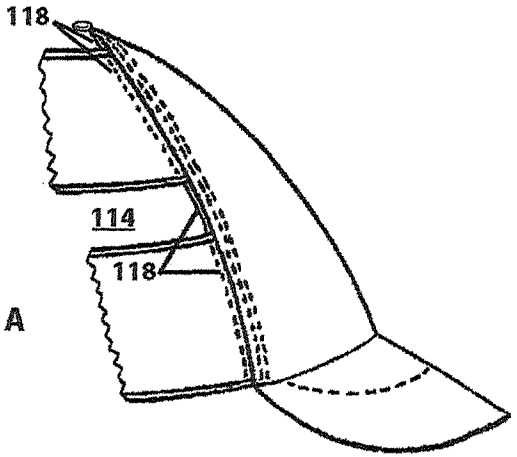
FIG. 1A is a side elevational view of a front section of the system shown in FIG. 1.

With reference now to the drawings, and in particular to FIG. 1 thereof, the preferred embodiment of the new and improved elastic cap system embodying the principles and concepts of the present invention and generally designated by the reference numeral 100 will be described.

The present invention, the elastic cap system 100 is comprised of a plurality of components. Such components in their broadest context include a crown portion and a circumferential portion. Such components are individually configured and correlated with respect to each other so as to attain the desired objective.

From a specific perspective, the invention of the present application is an elastic cap system 100. First provided is a crown portion 104 including one or more interrupted sections 110 extending vertically. Each interrupted section has one or more elastic sections 112. Each interrupted section also has one or more open sections 114 positioned between the elastic sections. Non-stretchable sections 116 are provided in a triangular configuration between the interrupted sections. Lining or tape 118 is stitched beneath the interrupted sections. A non-stretchable central cap button 120 is coupled to the upper ends of the interrupted sections.

Next provided is a circumferential portion 106 having a lower edge 122, a front, a back, a left side, and a right side. The circumferential portion includes non-stretchable sections 124 across the front and the back. The circumferential portion also includes elastic sections 126 positioned across the left side and the right side. Elastic sections of the interrupted sections extend to the lower edge of the circumferential portion.

Lastly, a visor 128 is provided. The visor extends forward from the lower edge of the circumferential portion and a rubber logo 130 is stitched over one of the non-stretchable sections of the circumferential portion.

Figure 2C:
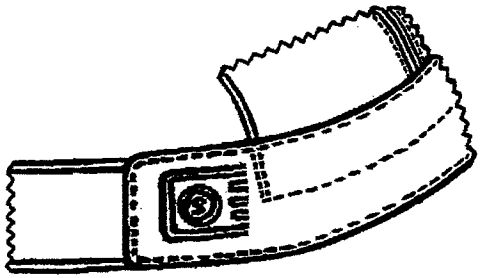
FIG. 2C is an elevational view of a side/rear section of the system shown in FIG. 2.
Figure 2B:
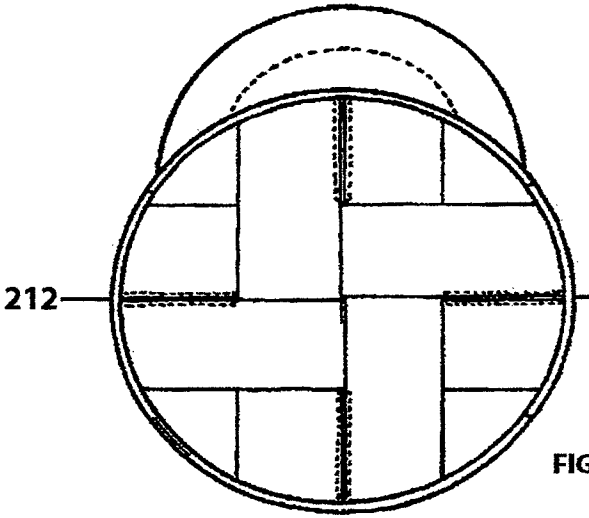
FIG. 2B is a plan view of the system shown in FIG. 2.
Figure 2:
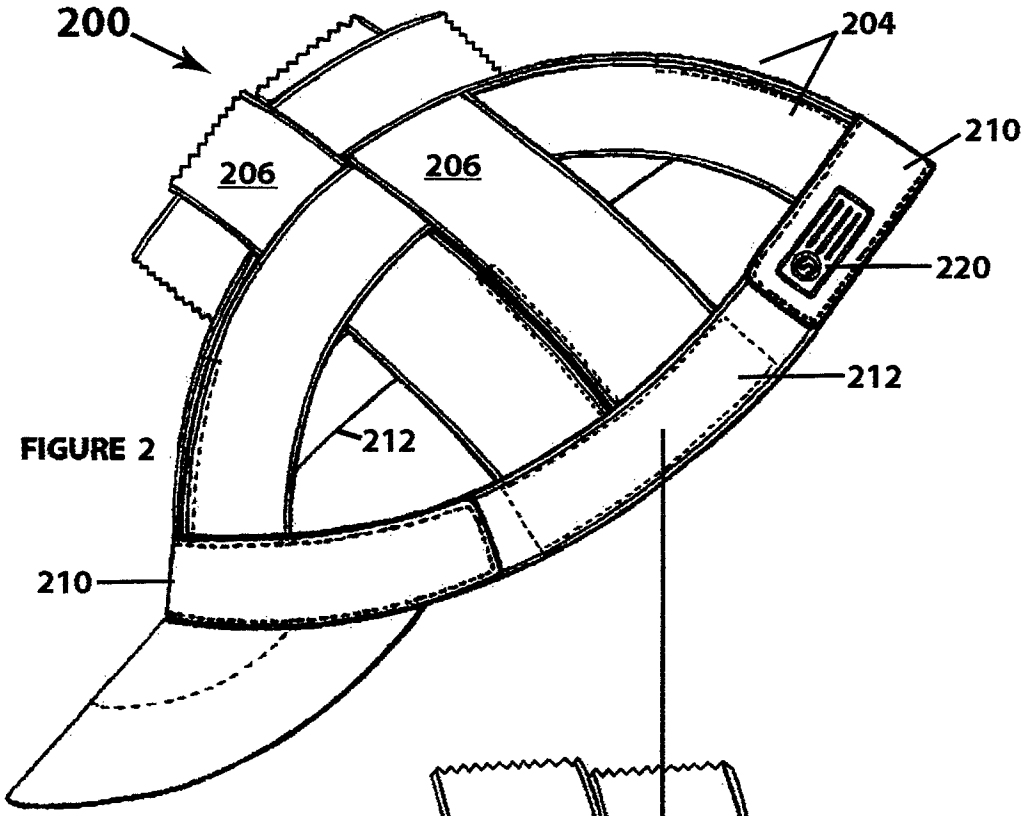
FIG. 2 is a side elevational view of an elastic cap system constructed in accordance with an alternate embodiment of the present invention.
Figure 2A:
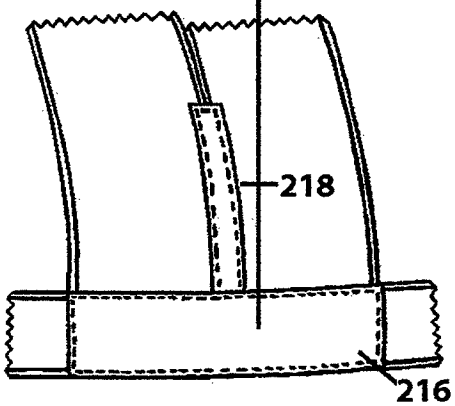
FIG. 2A is an elevational view of the inside lining section of the system shown in FIG. 2.

An alternate embodiment of the invention is shown in FIGS. 2 through 2C. In this embodiment of the system 200 the crown portion includes two continuous elastic longitudinal sections 204 with ends terminating at the circumferential portion. The crown portion also includes two continuous elastic transverse sections 206 with ends terminating at the circumferential portion. The circumferential portion also includes non-stretchable sections 210 across both the front and the back. The circumferential portion further includes elastic sections 212 across both the left side and the right side.

In this alternate embodiment, lining 216 is stitched beneath the elastic sections of the circumferential portion. Tape 218 is stitched over both the longitudinal section and the two continuous elastic transverse sections adjacent to the circumferential portion. Also in this alternate embodiment, rubber logo 220 is stitched over one of the non-stretchable sections of the circumferential portion.

Figure 3:
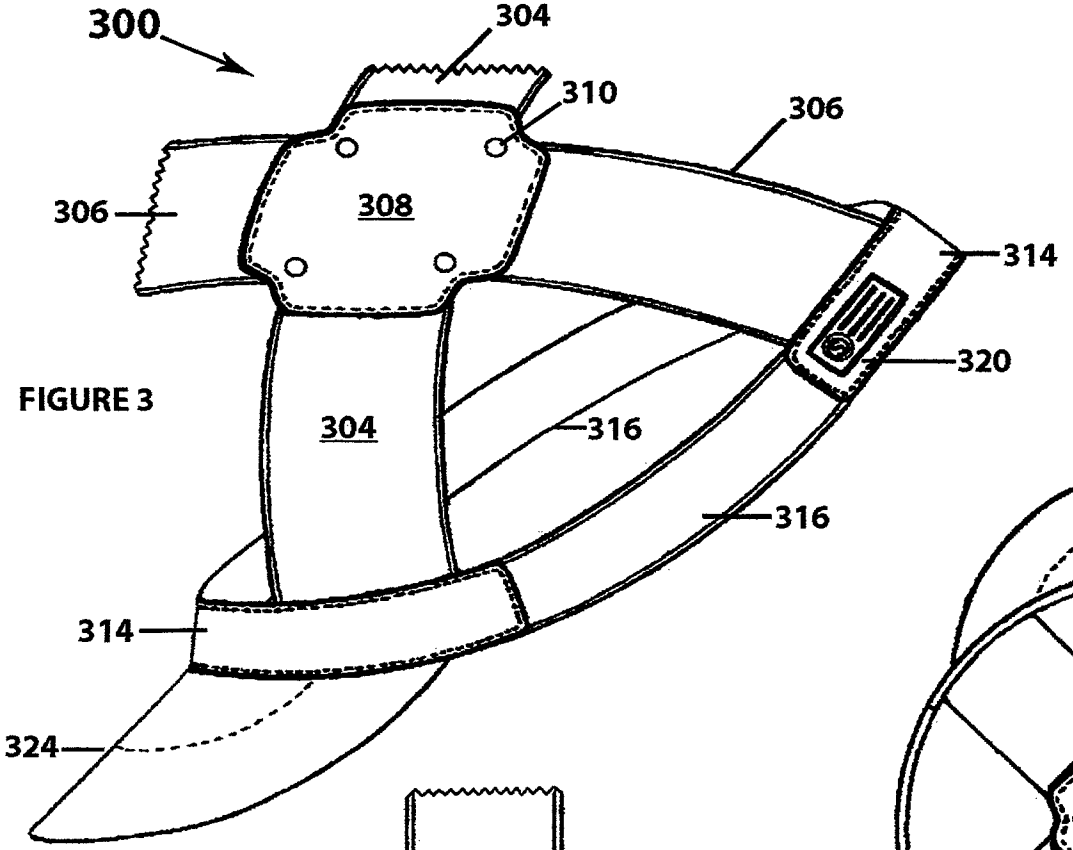
FIG. 3 is a perspective view of an elastic cap system constructed in accordance with another alternate embodiment of the present invention.
Figure 3C:
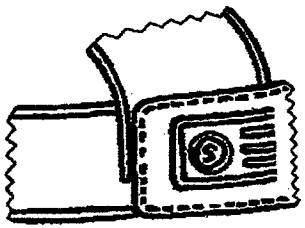
FIG. 3C is an elevational view of a side section of the system shown in FIG. 3.
Figure 3B:
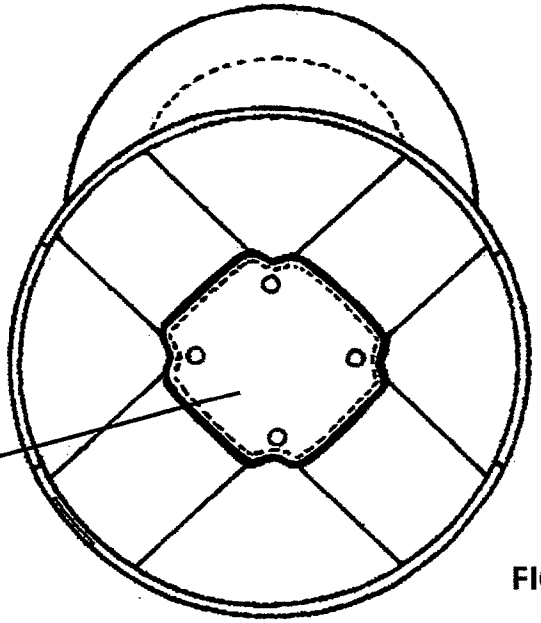
FIG. 3B is a plan view of the system shown in FIG. 3.
Figure 3A:
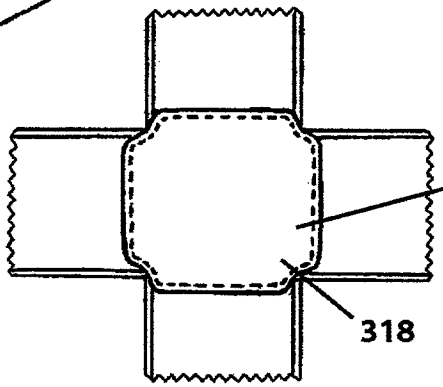
FIG. 3A is a bottom view of the central lining section of the system shown in FIG. 3.

A second alternate embodiment is shown in FIG. 3 through 3C. In this embodiment of the system 300 the crown portion includes one interrupted elastic transverse section 304 and one interrupted elastic transverse section 306. The interrupted elastic transverse sections have upper ends. Further included is a non-stretchable central component 308 with lining 318 plus nail heads 310 attached to central component 308. In this second alternate embodiment, the circumferential portion includes non-stretchable sections 314 across the front and the back.

Also in this second alternate embodiment, the circumferential portion includes elastic sections 316 across the left side and the right side. A rubber logo 320 is also provided on the non-elastic section of the circumferential portion. In this embodiment, a visor 324 is provided extending forwardly from the lower edge of the circumferential portion.

Figures 4, 4A, 4B, 4C:
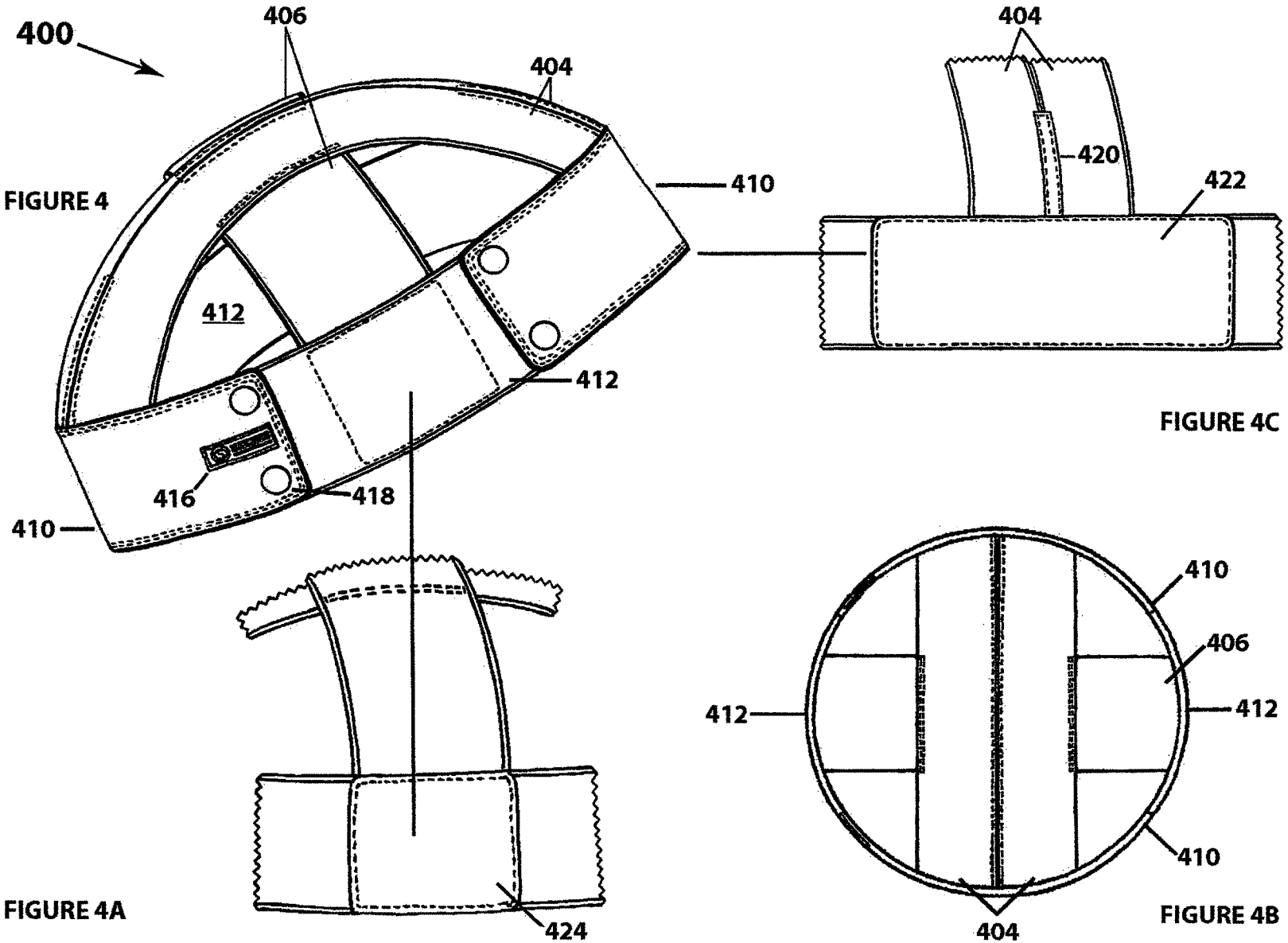
FIG. 4 is a perspective view of an elastic cap system constructed in accordance with yet another alternate embodiment of the present invention.
FIG. 4A is an elevational view of the lower/central lining section of the system shown in FIG. 4.
FIG. 4B is a plan view of the system shown in FIG. 4.
FIG. 4C is an elevational view of a rear/center lining section of the system shown in FIG. 4.

A final alternate embodiment of the system 400 is shown in FIGS. 4 through 4C. In this final alternate embodiment, the crown portion includes two continuous elastic longitudinal sections 404 with partial lining tape 420 and one continuous elastic transverse section 406. In this embodiment, the circumferential portion includes non-stretchable sections 410 across the front and the back with lining 422. The circumferential portion includes elastic sections 412 across the left side and the right sides with partial lining 424.

This final alternate embodiment includes a rubber logo 416 and nail heads 418 over the non-stretchable section of the circumferential portion.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An elastic band cap system comprising:

a crown portion comprising a plurality of interrupted sections extending vertically, a plurality of non-stretchable sections extending vertically and a circumferential portion having a lower edge;

linings or tapes stitched beneath the interrupted sections;

a non-stretchable central cap button coupled to the upper ends of the interrupted sections;

a visor extending forward from the lower edge of the circumferential portion;

and a rubber logo stitched over one of the non stretchable sections;

each non-stretchable section being in a triangular configuration between the interrupted sections;

each interrupted section being in a triangular configuration, each interrupted section having at least two elastic sections and at least two open sections; wherein at least one of the open sections is positioned between and adjacent to the at least two elastic sections and between and adjacent to the non-stretchable sections; wherein at least one of the open sections is positioned adjacent to the central cap button; wherein elastic sections are elastic bands;

the crown portion having a front, a back, a left side and a right side, the crown portion including the non-stretchable sections across the front and the back, the crown portion including the interrupted sections positioned across the left side and the right side, the elastic sections of the interrupted sections extending to the lower edge of the circumferential portion;

the interrupted sections and the non-stretchable sections each having a common vertical height between the lower edge and the central cap button, the interrupted sections and the non-stretchable sections each having a width adjacent to the lower edge, the width of the non-stretchable section adjacent to the lower edge being greater than the width of the interrupted section adjacent to the lower edge.

* * * * *